US011341833B2

(12) United States Patent
Kato et al.

(10) Patent No.: US 11,341,833 B2
(45) Date of Patent: May 24, 2022

(54) INDUSTRIAL PLANT MONITORING SYSTEM

(71) Applicant: SEIKO EPSON CORPORATION, Tokyo (JP)

(72) Inventors: Kazufumi Kato, Sakata (JP); Shingo Kumagai, Sakata (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/207,056

(22) Filed: Mar. 19, 2021

(65) Prior Publication Data

US 2021/0304579 A1 Sep. 30, 2021

(30) Foreign Application Priority Data

Mar. 25, 2020 (JP) ..... JP2020-053944

(51) Int. Cl.
*G08B 21/04* (2006.01)
*G08B 21/18* (2006.01)

(52) U.S. Cl.
CPC ..... *G08B 21/043* (2013.01); *G08B 21/0446* (2013.01); *G08B 21/182* (2013.01)

(58) Field of Classification Search
CPC ..... G08B 21/043
See application file for complete search history.

(56) References Cited

U.S. PATENT DOCUMENTS 7,944,369 B2 * 5/2011 Appleyard ..... G08B 13/1436 340/689
2007/0057804 A1 * 3/2007 Appleyard ..... G08B 13/1436 340/689
2014/0091927 A1 * 4/2014 Daniele ..... G08B 21/0208 340/539.13

FOREIGN PATENT DOCUMENTS

JP 2019012471 A 1/2019

* cited by examiner

*Primary Examiner* — Travis R Hunnings
(74) *Attorney, Agent, or Firm* — Chip Law Group

(57) ABSTRACT

An industrial plant monitoring system includes: a first terminal attached to a worker and having a gyro sensor generating inclination information based on a movement of the worker; a server receiving the inclination information; and a second terminal configured to communicate with the server. The server performs processing of acquiring a number of pieces of the inclination information generated during a predetermined period and exceeding a predetermined inclination angle, processing of determining whether the acquired number of pieces of the inclination information exceeds a predetermined value or not, and processing of transmitting first alarm information to the second terminal when it is determined that the number of pieces of the inclination information exceeds the predetermined value.

5 Claims, 7 Drawing Sheets

INDUSTRIAL PLANT MONITORING SYSTEM

The present application is based on, and claims priority from JP Application Serial Number 2020-053944, filed Mar. 25, 2020, the disclosure of which is hereby incorporated by reference herein in its entirety.

BACKGROUND

1. Technical Field

The present disclosure relates to an industrial plant monitoring system.

2. Related Art

With the application of automation and labor saving, it is desired that an industrial plant monitoring system that prevents a worker from being left fallen for a long period in an industrial plant due to a sudden injury, illness or the like is constructed.

For example, JP-A-2019-12471 discloses an information processing system that detects that a worker is in an abnormal state when it is determined that the worker remains in an immobile state for a predetermined time or longer after falling off or falling over, based on acceleration data measured by an acceleration sensor.

However, in JP-A-2019-12471, it is determined that the worker remains in an immobile state after it is determined that the worker has fallen off or fallen over. Therefore, when the system fails to detect the falling off or falling over of the worker, the system may overlook the abnormal state.

SUMMARY

An industrial plant monitoring system according to an aspect of the present disclosure includes: a first terminal attached to a worker and having a gyro sensor generating inclination information based on a movement of the worker; a server receiving the inclination information; and a second terminal configured to communicate with the server. The server performs processing of acquiring a number of pieces of the inclination information generated during a predetermined period and exceeding a predetermined inclination angle, processing of determining whether the acquired number of pieces of the inclination information exceeds a predetermined value or not, and processing of transmitting first alarm information to the second terminal when it is determined that the number of pieces of the inclination information exceeds the predetermined value.

DESCRIPTION OF EXEMPLARY EMBODIMENTS

A preferred embodiment of the present disclosure will now be described in detail with reference to the drawings. The embodiment described below should not unduly limit the content of the present disclosure described in the appended claims. Not all the components described below are necessarily essential components of the present disclosure.

1. Industrial Plant Monitoring System 1.1. Configuration

Figure 1:
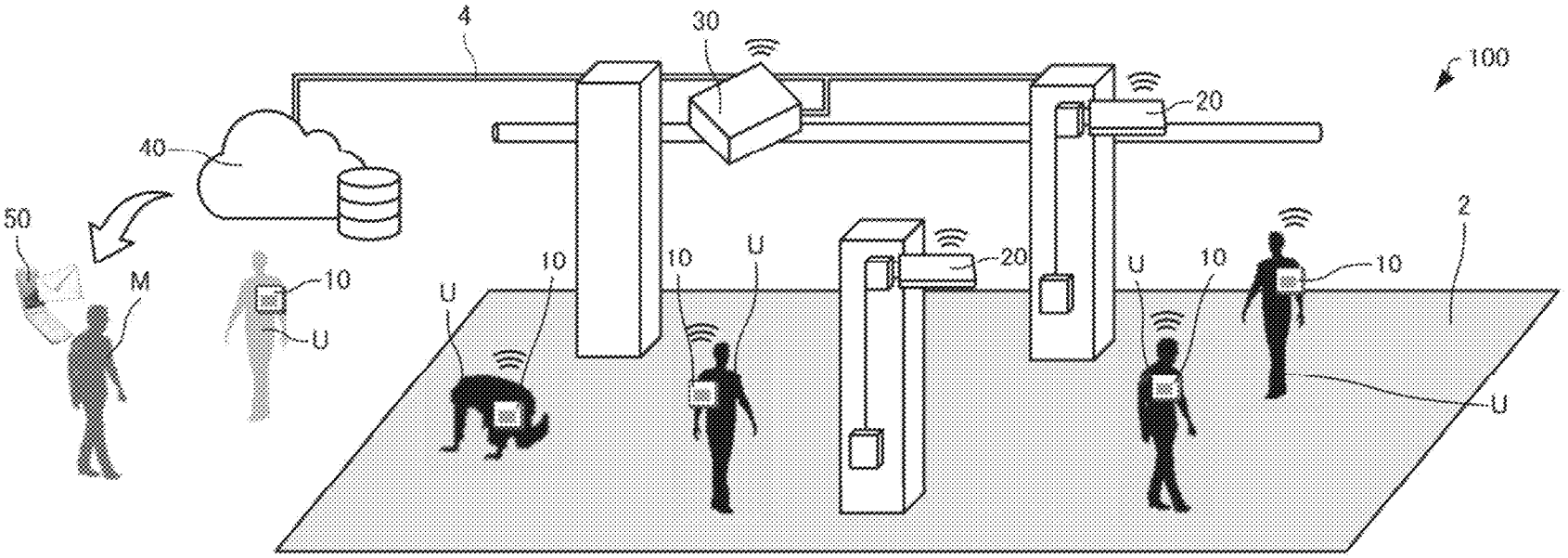
FIG. 1 schematically shows an industrial plant monitoring system according to an embodiment.
Figure 2:
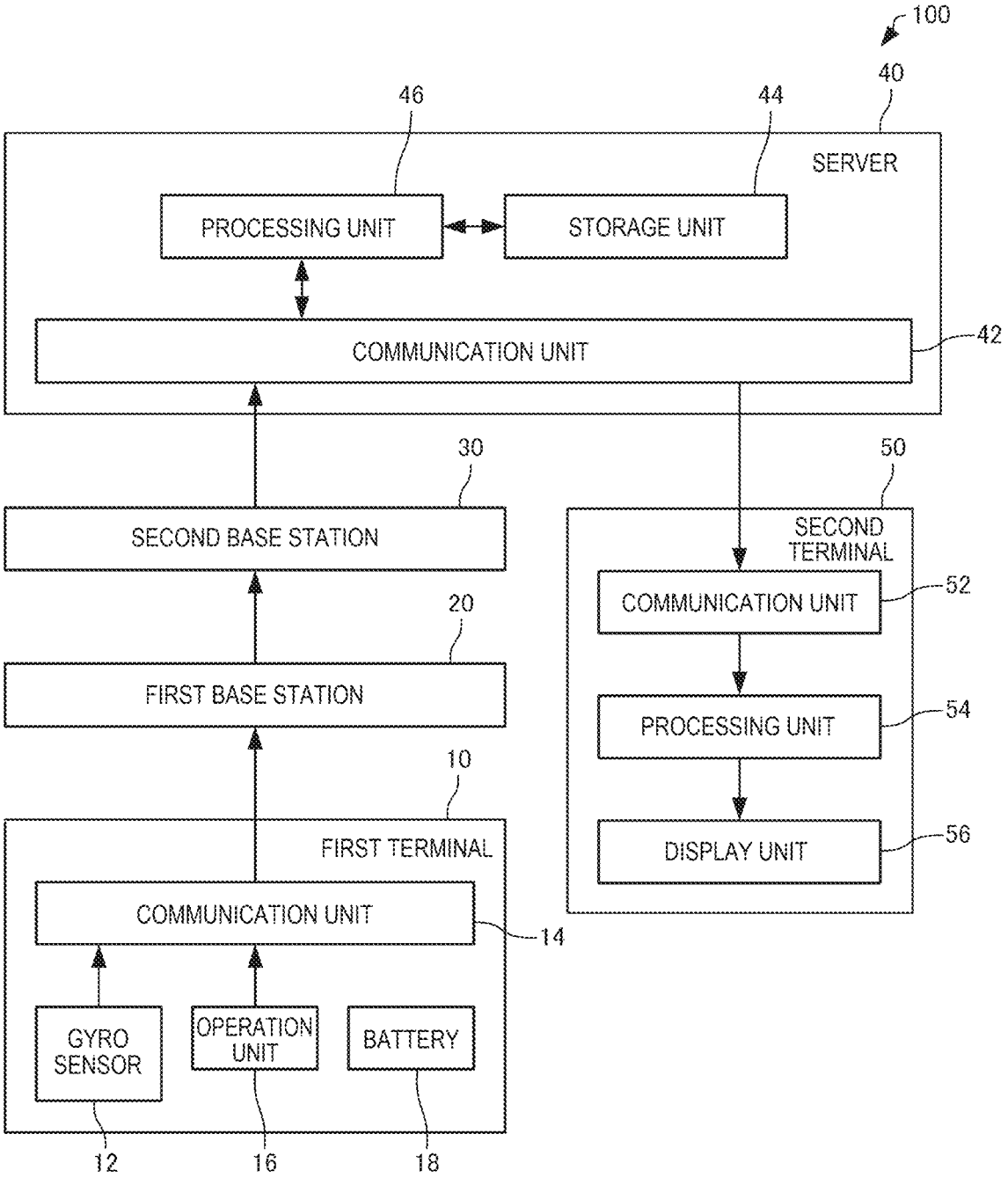
FIG. 2 is a functional block diagram of the industrial plant monitoring system according to the embodiment.

An industrial plant monitoring system according to this embodiment will be described with reference to the drawings. FIG. 1 schematically shows an industrial plant monitoring system 100 according to this embodiment. FIG. 2 is a functional block diagram of the industrial plant monitoring system 100 according to this embodiment.

The industrial plant monitoring system 100 is a system monitoring an industrial plant. The industrial plant monitored by the industrial plant monitoring system 100 is not particularly limited but may be, for example, a semiconductor fabrication plant or the like. The industrial plant monitoring system 100 includes, for example, a first terminal 10, a first base station 20, a second base station 30, a server 40, and a second terminal 50, as shown in FIGS. 1 and 2.

The first terminal 10 is attached to a worker U, as shown in FIG. 1. The first terminal 10 is attached, for example, to the chest or arm of the worker U. A plurality of workers U are arranged in the industrial plant. The first terminal 10 is attached to each of the plurality of workers U. In FIG. 2, only one first terminal 10 is shown for the sake of convenience.

The first terminal 10 has, for example, a gyro sensor 12, a communication unit 14, an operation unit 16, and a battery 18, as shown in FIG. 2.

The gyro sensor 12 detects an inclination angle to a predetermined axis (for example, a horizontal axis). The gyro sensor 12 generates inclination information based on a movement of the worker U. The inclination information is information about the inclination angle of the gyro sensor 12 attached to the worker U. The gyro sensor 12 generates inclination information only when the worker U moves. That is, when the worker U is in a stationary state, the gyro sensor 12 does not generate inclination information. Thus, the power consumption by the first terminal 10 can be reduced.

The communication unit 14 transmits the inclination information generated by the gyro sensor 12 to the first base station 20. The first terminal 10 is given an ID (identification). For example, when transmitting the inclination information, the communication unit 14 transmits the ID of the first terminal 10 as identification information to the first base station 20.

The communication unit 14 includes, for example, a transmitter/receiver supporting a wireless communication standard such as Bluetooth (trademark registered), Wi-Fi (Wireless Fidelity, trademark registered), Zigbee (trademark registered), NFC (near-field communication), or ANT+ (trademark registered).

The operation unit 16 is operated by the worker U. The operation unit 16 is formed of, for example, a button, touch panel or the like. When the operation unit 16 is operated, the first terminal 10 generates an operation signal. The communication unit 14 transmits the operation signal to the first base station 20. When the worker U taps the operation unit 16 a predetermined number of times during a predetermined period, the first terminal 10 generates an operation signal, and the communication unit 14 transmits the generated operation signal to the first base station 20.

The battery 18 is the power supply of the first terminal 10. For example, when transmitting the inclination information, the communication unit 14 transmits the remaining capacity of the battery 18 as remaining battery capacity information to the first base station 20.

The first base station 20 receives the inclination information from the first terminal 10 and transmits the received inclination information to the second base station 30. The first base station 20 also transmits, to the second base station 30, the identification information and the remaining battery capacity information of the first terminal 10 from which the first base station 20 has received the inclination information. Also, when transmitting the inclination information to the second base station 30, the first base station 20 transmits position information of the first base station 20 to the second base station 30. The position information is information about the place where the first base station 20 is arranged, for example, "building no. 12 1F_development section_aisle". The first base station 20 also receives the operation signal from the first terminal 10 and transmits the received operation signal to the second base station 30. Hereinafter, the inclination information, the identification information, the remaining battery capacity information, the position information, and the operation signal are also referred to as "inclination information and the like".

The first base station 20 is a repeater for transmitting the inclination information and the like to the second base station 30, which is a receiver. In the example shown in FIG. 1, a plurality of first base stations 20 are provided in a monitoring target area 2, which is a target of monitoring by the industrial plant monitoring system 100. In the monitoring target area 2, only one second base station 30 is provided. In FIG. 2, only one first base station 20 is shown for the sake of convenience. The first base station 20 includes, for example, a transmitter/receiver supporting a wireless communication standard, similarly to the communication unit 14.

The second base station 30 receives the inclination information and the like from the first base station 20 and transmits the received inclination information to the server 40. The second base station 30 includes, for example, a transmitter/receiver supporting a wireless communication standard, similarly to the communication unit 14.

The server 40 can communicate with the second base station 30, for example, via a network 4, as shown in FIG. 1. The network 4 may be wired or wireless. The server 40 has, for example, a communication unit 42, a storage unit 44, and a processing unit 46, as shown in FIG. 2.

The communication unit 42 receives the inclination information and the like, for example, via the base stations 20, 30. The communication unit 42 also transmits alarm information generated by the processing unit 46 to the second terminal 50. The communication unit 42 includes, for example, a transmitter/receiver supporting a wireless communication standard, similarly to the communication unit 14.

The storage unit 44 stores a program, data, and the like for the processing unit 46 to perform various kinds of calculation processing and control processing. The storage unit 44 is also used as a work area for the processing unit 46 and temporarily stores information received via the communication unit 42 and the results of computations executed by the processing unit 46 according to various programs, and the like.

The storage unit 44 stores, for example, a table where the IDs of a plurality of first terminals 10, a group name to which the worker U wearing the first terminal 10 belongs, and a threshold of the inclination angle for transmitting the alarm information, and the like, are associated with each other.

The processing unit 46 performs various kinds of calculation processing and control processing according to the program stored in the storage unit 44. Specifically, the processing unit 46 receives the inclination information and the like from the first terminal 10 via the communication unit 42 and performs various kinds of processing.

For example, when the communication unit 42 receives the inclination information from a plurality of base stations 20, 30 with respect to one first terminal 10, the processing unit 46 performs various kinds of processing, based on the inclination information from the base station 20, 30 having the highest radio wave intensity of the plurality of base stations 20, 30. The radio wave intensity correlates with the distance between the first terminal 10 and the base station 20, 30. Therefore, performing processing of transmitting the alarm information to the second terminal 50 based on the inclination information and the like from the base station 20, 30 having the highest radio wave intensity enables a manager M having the second terminal 50 to know the nearest base station 20, 30 to the worker U wearing the first terminal 10 generating the inclination information and the like. Details of the processing by the processing unit 46 will be described later.

The processing unit 46 is formed of, for example, a CPU (central processing unit), MPU (micro processing unit), DSP (digital signal processor), ASIC (application-specific integrated circuit), or the like.

The second terminal 50 can communicate with the server 40 via a wired or wireless network. The second terminal 50 is held, for example, by the manager M of the industrial plant, as shown in FIG. 1. The second terminal 50 has, for example, a communication unit 52, a processing unit 54, and a display unit 56, as shown in FIG. 2.

The communication unit 52 receives the alarm information from the server 40. The alarm information is received, for example, as an email. The processing unit 54 performs processing of causing the display unit 56 to display the alarm information received by the communication unit 52. By this processing, the alarm information is displayed on the display unit 56. As shown in FIG. 1, the manager M of the industrial plant can learn the state of the worker U, based on the alarm information displayed on the display unit 56. Details of the alarm information will be described later.

The communication unit 52 includes, for example, a transmitter/receiver supporting a wireless communication standard, similarly to the communication unit 14. The processing unit 54 is formed of, for example, a CPU or the like, similarly to the processing unit 46. The display unit 56 is formed of, for example, an LCD (liquid crystal display), organic EL (electroluminescence) display, EPD (electrophoretic display), touch panel display, or the like. The second terminal 50 is, for example, a mobile phone including a smartphone, or a personal computer or the like.

The second base station 30 may receive the inclination information directly from the first terminal 10 without via the first base station 20 and transmit the received inclination information to the server 40. In this case, when transmitting the inclination information to the server 40, the second base station 30 may transmit information about the position of the second base station 30 to the server 40. The server 40 may receive the inclination information directly from the first terminal 10 without via the base stations 20, 30.

The industrial plant monitoring system 100 may also include a sensor, not illustrated, which automatically detects the entry and exit of the worker U to and from the monitoring target area 2. The sensor may be provided at an entrance/exit of the monitoring target area 2. The server 40 determines whether the worker U is in the monitoring target area 2 or not, based on the result of detection by the sensor, and may not generate the alarm information when the inclination information is received from the first terminal 10 of the worker U who is not in the monitoring target area 2. Alternatively, the first terminal 10 may be configured not to transmit the inclination information when the worker U is not in the monitoring target area 2. Alternatively, the base stations 20, 30 may be configured not to transmit the inclination information when the worker U is not in the monitoring target area 2.

1.2. Processing by Server

Figure 3:
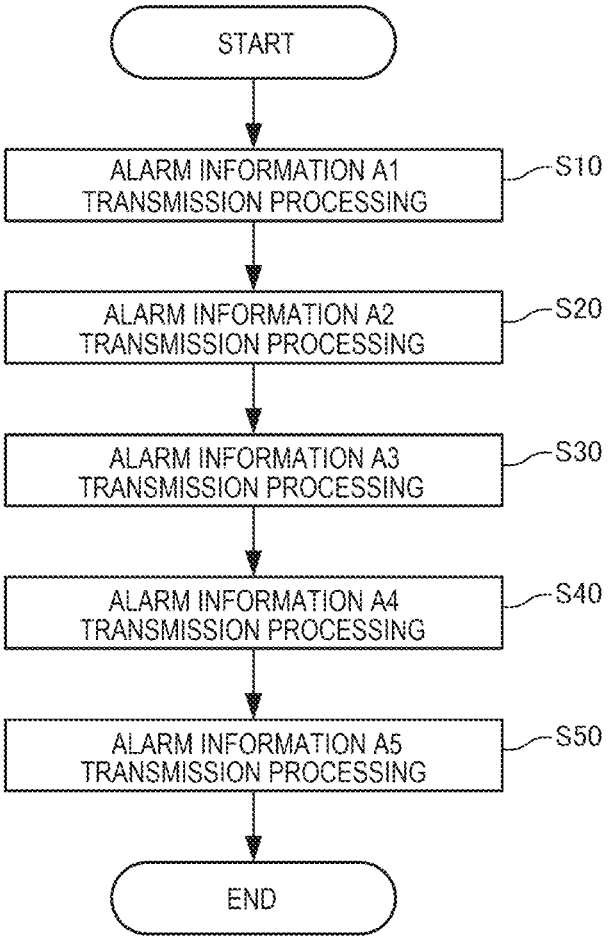
FIG. 3 is a flowchart explaining processing by a server in the industrial plant monitoring system according to the embodiment.

Specific processing by the server 40 will be described with reference to the drawings. FIG. 3 is a flowchart for explaining the processing by the server 40.

In the description below, processing to one first terminal 10 is described. Also, in the description below, a case where the server 40 receives the inclination information and the like from the first terminal 10 via the first base station 20 and the second base station 30 is described.

The processing unit 46 of the server 40 performs alarm information A1 transmission processing of transmitting alarm information A1 (step S10), alarm information A2 transmission processing of transmitting alarm information A2 (step S20), alarm information A3 transmission processing of transmitting alarm information A3 (step S30), alarm information A4 transmission processing of transmitting alarm information A4 (step S40), and alarm information A5 transmission processing of transmitting alarm information A5 (step S50), as shown in FIG. 3. The processing unit 46 then ends the processing. Each processing will now be described specifically.

1.2.1. Alarm Information A1 Transmission Processing

Figure 4:
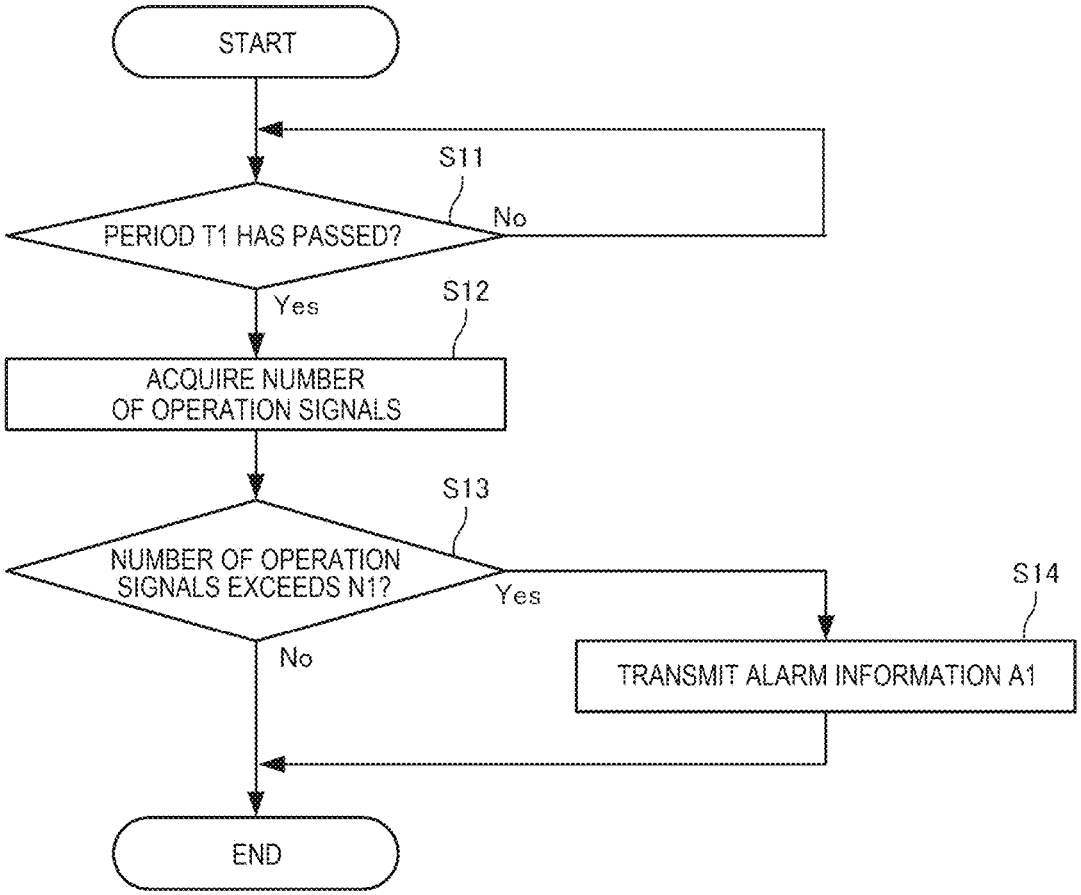
FIG. 4 is a flowchart explaining processing by the server in the industrial plant monitoring system according to the embodiment.

FIG. 4 is a flowchart for explaining the alarm information A1 transmission processing (step S10) by the processing unit 46.

As shown in FIG. 4, the processing unit 46 of the server 40 waits until a first predetermined period T1 passes ("No" in step S11). When it is determined that the first predetermined period T1 is elapsed ("Yes" in step S11), the processing unit 46 performs processing of acquiring the number of operation signals generated during the first predetermined period T1 (step S12). The operation signal is generated by the worker U operating the operation unit 16 of the first terminal 10 and is transmitted to the server 40 via the base stations 20, 30.

Specifically, the server 40 receives the operation signal from the second base station 30 every second predetermined period T2 that is shorter than the first predetermined period T1. The processing unit 46 causes the storage unit 44 of the server 40 to store the received operation signal. As the first predetermined period T1 is elapsed, the processing unit 46 reads out the operation signal stored in the storage unit 44 and acquires the number of operation signals generated during the first predetermined period T1. The predetermined periods T1, T2 are suitably decided and not particularly limited. For example, the first predetermined period T1 is three minutes and the second predetermined period T2 is one minute. Information about the predetermined periods T1, T2 is stored, for example, in the storage unit 44.

Next, the processing unit 46 determines whether the acquired number of operation signals exceeds a predetermined value N1 or not (step S13). The predetermined value N1 is suitably decided and not particularly limited. For example, the predetermined value N1 is 10 to 20. Information about the predetermined value N1 is stored, for example, in the storage unit 44.

When it is determined that the acquired number of operation signals does not exceed the predetermined value N1 ("No" in step S13), the processing unit 46 ends the alarm information A1 transmission processing (step S10).

Meanwhile, when it is determined that the acquired number of operation signals exceeds the predetermined value N1 ("Yes" in step S13), the processing unit 46 executes processing of transmitting the alarm information A1 to the second terminal 50 (step S14). The processing unit 46 then ends the alarm information A1 transmission processing (step S10).

The alarm information A1 includes, for example, the acquired number of operation signals, the identification information of the first terminal 10 generating the operation signal, the time when the operation signal is generated, and the position information of the first base station 20 receiving the operation signal from the first terminal 10. The alarm information A1 informs the manager M having the second terminal 50 that there is an emergency call from the worker U.

1.2.2. Alarm Information A2 Transmission Processing

Figure 5:
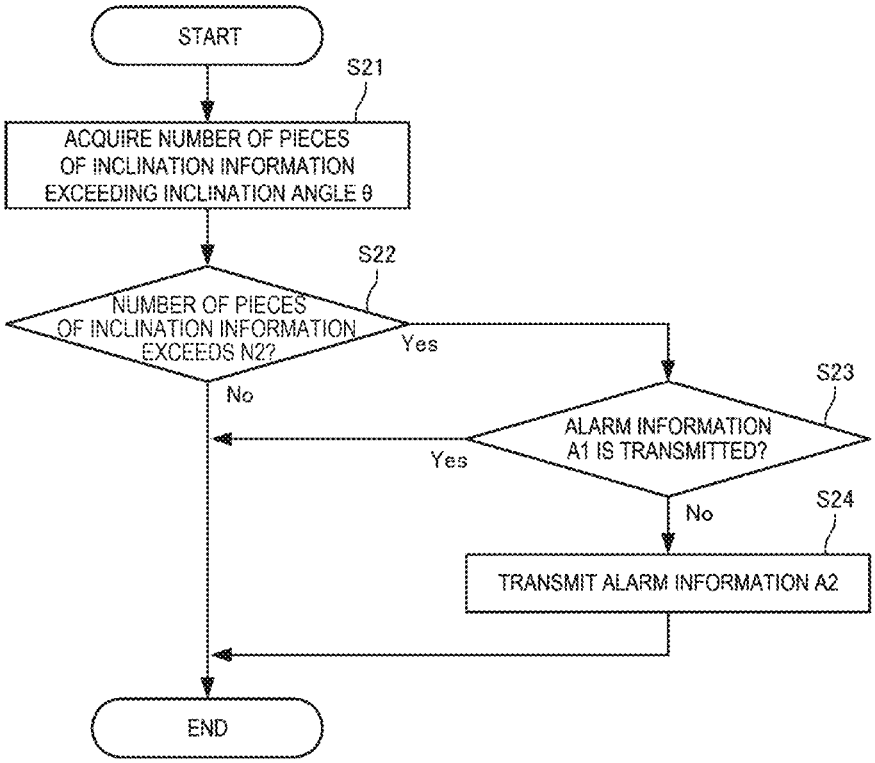
FIG. 5 is a flowchart explaining processing by the server in the industrial plant monitoring system according to the embodiment.

On ending the alarm information A1 transmission processing (step S10), the processing unit 46 performs the alarm information A2 transmission processing (step S20). FIG. 5 is a flowchart for explaining the alarm information A2 transmission processing (step S20) by the processing unit 46.

As shown in FIG. 5, the processing unit 46 performs processing of acquiring the number of pieces of the inclination information generated during the first predetermined period T1 exceeding a predetermined inclination angle θ (step S21). The inclination information is generated by the gyro sensor 12 of the first terminal 10, based on a movement of the worker U, and is transmitted to the server 40 via the base stations 20, 30. The predetermined inclination angle θ is suitably decided and not particularly limited. The predetermined inclination angle θ is, for example, 60° to 70°. Information about the predetermined inclination angle θ is stored, for example, in the storage unit 44.

Specifically, the processing unit 46 receives the inclination information from the second base station 30 every second predetermined period T2 that is shorter than the first predetermined period T1 and causes the storage unit 44 of the server 40 to store the received inclination information. When the first predetermined period T1 is elapsed, the processing unit 46 reads out the inclination information stored in the storage unit 44 and acquires the number of pieces of the inclination information generated during the first predetermined period T1 and exceeding the predetermined inclination angle θ.

Next, the processing unit 46 performs processing of determining whether the acquired number of pieces of the inclination information exceeding the predetermined inclination angle θ exceeds a predetermined value N2 or not (step S22). The predetermined value N2 is suitably decided and not particularly limited. The predetermined value N2 is, for example, 10 to 30. Information about the predetermined value N2 is stored, for example, in the storage unit 44.

When it is determined that the acquired number of pieces of the inclination information exceeding the predetermined inclination angle θ does not exceed the predetermined value N2 ("No" in step S22), the processing unit 46 ends the alarm information A2 transmission processing (step S20).

Meanwhile, when it is determined that the acquired number of pieces of the inclination information exceeding the predetermined inclination angle θ exceeds the predetermined value N2 ("Yes" in step S22), the processing unit 46 performs processing of determining whether the alarm information A1 is transmitted to the second terminal 50 in step S14 or not (step S23).

When it is determined that the alarm information A1 is transmitted to the second terminal 50 ("Yes" in step S23), the processing unit 46 ends the alarm information A2 transmission processing (step S20).

Meanwhile, when it is determined that the alarm information A1 is not transmitted to the second terminal 50 ("No" in step S23), the processing unit 46 performs processing of transmitting the alarm information A2 to the second terminal 50 (step S24). The processing unit 46 then ends the alarm information A2 transmission processing (step S20).

The alarm information A2 includes, for example, the number of pieces of the inclination information exceeding the predetermined inclination angle θ, the identification information of the first terminal 10 generating the inclination information, the time when the inclination information is generated, and the position information of the first base station 20 receiving the inclination information from the first terminal 10. The alarm information A2 informs the manager M having the second terminal 50 that the worker U has continuously fallen over.

1.2.3. Alarm Information A3 Transmission Processing

Figure 6:
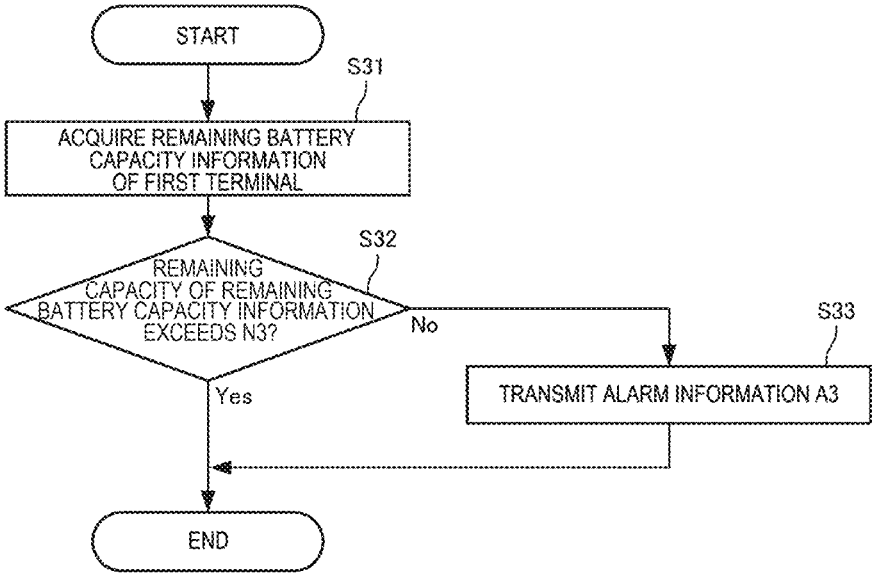
FIG. 6 is a flowchart explaining processing by the server in the industrial plant monitoring system according to the embodiment.

On ending the alarm information A2 transmission processing (step S20), the processing unit 46 performs the alarm information A3 transmission processing (step S30). FIG. 6 is a flowchart for explaining the alarm information A3 transmission processing (step S30) by the processing unit 46.

As shown in FIG. 6, the processing unit 46 performs processing of acquiring the remaining battery capacity information of the first terminal 10 generated during the first predetermined period T1 (step S31). The remaining battery capacity information is generated by the first terminal 10 and transmitted to the server 40 via the base stations 20, 30.

Next, the processing unit 46 performs processing of determining whether the remaining capacity of the acquired remaining battery capacity information exceeds a predetermined value N3 or not (step S32).

When it is determined that the remaining capacity of the remaining battery capacity information exceeds the predetermined value N3 ("Yes" in step S32), the processing unit 46 ends the alarm information A3 transmission processing (step S30).

Meanwhile, when it is determined that the remaining capacity of the remaining battery capacity information does not exceed the predetermined value N3 ("No" in step S32), the processing unit 46 performs processing of transmitting the alarm information A3 to the second terminal 50 (step S33). The processing unit 46 then ends the alarm information A3 transmission processing (step S30).

The alarm information A3 includes, for example, information that the remaining capacity of the remaining battery capacity information does not exceed the predetermined value N3, the identification information of the first terminal 10 generating the remaining battery capacity information, and the time when the remaining battery capacity information is generated. The alarm information A3 informs the manager M having the second terminal 50 that the remaining capacity of the battery 18 of the first terminal 10 is low. Thus, the manager M can instruct the worker U wearing the first terminal 10 generating the remaining battery capacity information, to replace the battery.

1.2.4. Alarm Information A4 Transmission Processing

Figure 7:
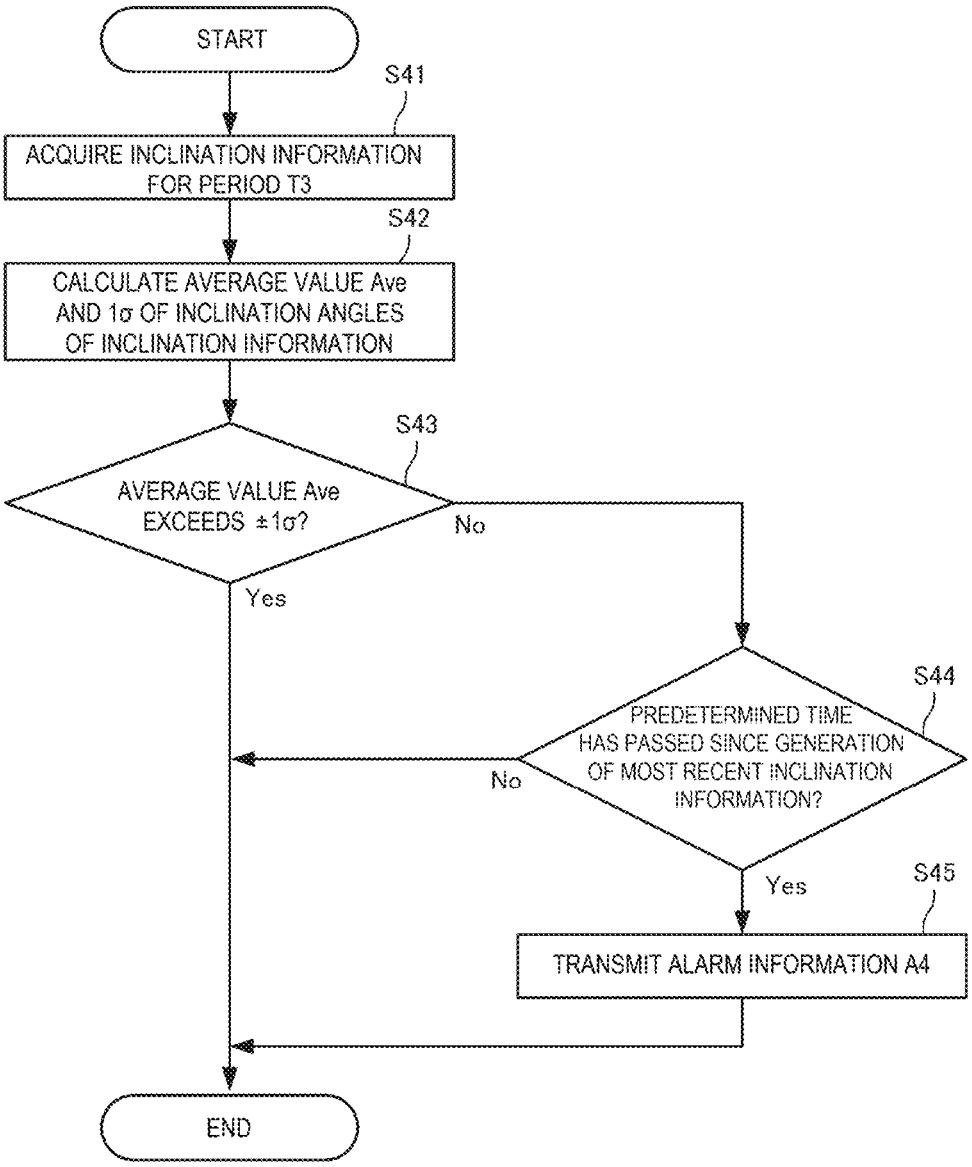
FIG. 7 is a flowchart explaining processing by the server in the industrial plant monitoring system according to the embodiment.

On ending the alarm information A3 transmission processing (step S30), the processing unit 46 performs the alarm information A4 transmission processing (step S40). FIG. 7 is a flowchart for explaining the alarm information A4 transmission processing (step S40) by the processing unit 46.

Figure 8:
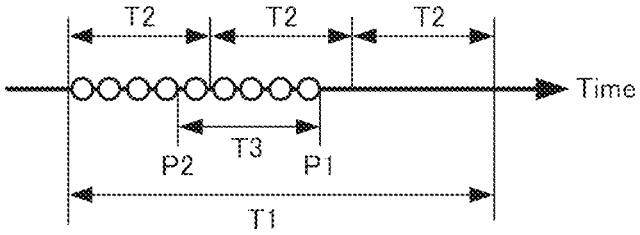
FIG. 8 explains processing by the server in the industrial plant monitoring system according to the embodiment.

As shown in FIG. 7, the processing unit 46 acquires the inclination information generated during a third predetermined period T3, which is a period from a time point when the most recent inclination information is received to a predetermined time point in the past (step S41). The third predetermined period T3 is suitably decided and not particularly limited. The third predetermined period T3 is, for example, one minute. Information about the third predetermined period T3 is stored, for example, in the storage unit 44. FIG. 8 explains the processing in step S41 by the processing unit 46.

Specifically, the processing unit 46 receives the inclination information from the second base station 30 every second predetermined period T2, as shown in FIG. 8, and causes the storage unit 44 of the server 40 to store the received inclination information. As the first predetermined period T1 is elapsed, the processing unit 46 reads out the inclination information stored in the storage unit 44 and acquires the inclination information generated during the third predetermined period T3, which is a period from a time point P1 when the most recent inclination information is received to a predetermined time point P2 in the past. In the illustrated example, the generated inclination information is represented by "o" and "the most recent inclination information" is the ninth inclination information from left. The gyro sensor 12 of the first terminal 10 does not generate the inclination information when the worker U is in a stationary state. Therefore, the illustrated example means that the worker U is in a stationary state from the time point P1 onward.

Next, as shown in FIG. 7, the processing unit 46 performs processing of calculating an average value Ave and 1σ (standard deviation) of the inclination angles of the inclination information acquired as generated during the third predetermined period T3 (step S42).

Next, the processing unit 46 performs processing of determining whether the average value Ave exceeds a range of ±1σ from −1σ to +1σ or not (step S43).

When it is determined that the average value Ave exceeds the range of ±1σ ("Yes" in step S43), the processing unit 46 ends the alarm information A4 transmission processing (step S40).

Meanwhile, when it is determined that the average value Ave does not exceeds the range of ±1σ ("No" in step S43), the processing unit 46 performs processing of determining whether a predetermined time is elapsed after the generation of the most recent inclination information or not (step S44). The predetermined time is suitably decided and not particularly limited. The predetermined time is, for example, one minute. Information about the predetermined time is stored, for example, in the storage unit 44.

When it is determined that the predetermined time has not passed ("No" in step S44), the processing unit 46 ends the alarm information A4 transmission processing (step S40).

Meanwhile, when it is determined that the predetermined time is elapsed ("Yes" in step S44), the processing unit 46 performs processing of transmitting the alarm information A4 to the second terminal 50 (step S45). The processing unit 46 then ends the alarm information A4 transmission processing (step S40).

1.2.5. Alarm Information A5 Transmission Processing

Figure 9:
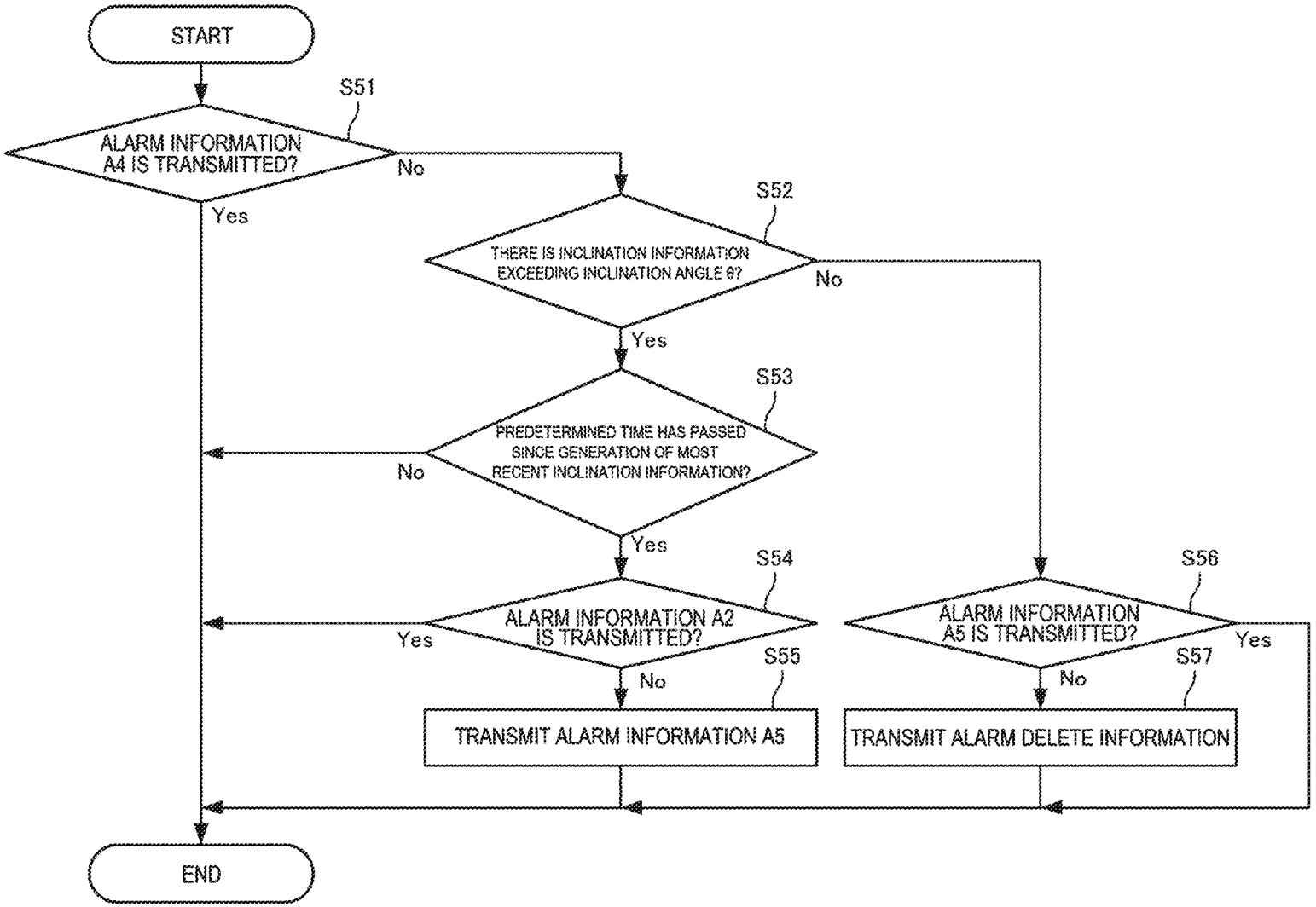
FIG. 9 is a flowchart explaining processing by the server in the industrial plant monitoring system according to the embodiment.

On ending the alarm information A4 transmission processing (step S40), the processing unit 46 performs the alarm information A5 transmission processing (step S50). FIG. 9 is a flowchart for explaining the alarm information A5 transmission processing (step S50) by the processing unit 46.

As shown in FIG. 9, the processing unit 46 performs processing of determining whether the alarm information A4 is transmitted to the second terminal 50 in step S45 or not (step S51).

When it is determined that the alarm information A4 is transmitted to the second terminal 50 ("Yes" in step S51), the processing unit 46 ends the alarm information A5 transmission processing (step S50).

Meanwhile, when it is determined that the alarm information A4 is not transmitted to the second terminal 50 ("No" in step S51), the processing unit 46 performs processing of determining whether three is inclination information exceeding the predetermined inclination angle θ, in the inclination information generated during the first predetermined period T1, or not (step S52).

When it is determined that there is inclination information exceeding the predetermined inclination angle θ ("Yes" in step S52), the processing unit 46 performs processing of determining whether a predetermined time is elapsed after the generation of the most recent inclination information or not (step S53). The predetermined time is suitably decided and not particularly limited. The predetermined time is, for example, two minutes. Information about the predetermined time is stored, for example, in the storage unit 44.

When it is determined that the predetermined time has not passed since the generation of the most recent inclination information ("No" in step S53), the processing unit 46 ends the alarm information A5 transmission processing (step S50).

Meanwhile, when it is determined that the predetermined time is elapsed after the generation of the most recent inclination information ("Yes" in step S53), the processing unit 46 performs processing of determining whether the alarm information A2 is transmitted to the second terminal 50 in step S24 or not (step S54).

When it is determined that the alarm information A2 is transmitted to the second terminal 50 ("Yes" in step S54), the processing unit 46 ends the alarm information A5 transmission processing (step S50).

Meanwhile, when it is determined that the alarm information A2 is not transmitted to the second terminal 50 ("No" in step S54), the processing unit 46 performs processing of transmitting the alarm information A5 to the second terminal 50 (step S55). The processing unit 46 then ends the alarm information A5 transmission processing (step S50).

The alarm information A5 includes, for example, the inclination angle of the inclination information, the time when the most recent inclination information is generated, the time that is elapsed after the generation of the most recent inclination information, the identification information of the first terminal generating the inclination information, and the position information of the first base station 20 receiving the inclination information from the first terminal 10. The alarm information A5 informs the manager M having the second terminal 50 that there is no response from the worker U.

When it is determined that there is no inclination information exceeding the predetermined inclination angle θ ("No" in step S52), the processing unit 46 performs processing of determining whether the alarm information A5 is transmitted to the second terminal 50 in step S55 or not (step S56).

When it is determined that the alarm information A5 is transmitted to the second terminal 50 ("Yes" in step S56), the processing unit 46 ends the alarm information A5 transmission processing (step S50).

Meanwhile, when it is determined that the alarm information A5 is not transmitted to the second terminal 50 ("No" in step S56), the processing unit 46 performs processing of transmitting alarm delete information to the second terminal 50 (step S57). The processing unit 46 then ends the alarm information A5 transmission processing (step S50).

The alarm delete information is information for deleting the alarm information A5 transmitted in step S55. The alarm delete information informs the manager M having the second terminal 50 that a recovery from the no-response state of the worker U is made.

1.3. Advantageous Effects

In the industrial plant monitoring system 100, the server 40 performs the processing of acquiring the number of pieces of the inclination information generated during the first predetermined period T1 and exceeding the predetermined inclination angle θ (step S21), the processing of determining whether the acquired number of pieces of the inclination information exceeds the predetermined value N2 or not (step S22), and the processing of transmitting the alarm information (first alarm information) A2 to the second terminal 50 when it is determined that the number of pieces of the inclination information exceeds the predetermined value N2 (step S24). Therefore, the manager M having the second terminal 50 receiving the alarm information A2 can be informed, for example, that the worker U has become unable to stand normally and has continuously fallen over. Thus, the industrial plant monitoring system 100 can prevent the worker U from being left fallen for a long period.

Also, in the industrial plant monitoring system 100, the determination processing is not performed based on only a falling over of the worker U. Therefore, even when the system fails to detect only a falling over, it is highly probable that the system can detect an abnormal state of the worker U.

In the industrial plant monitoring system 100, the server 40 performs the processing of acquiring the number of operation signals generated during the first predetermined period T1 (step S12), the processing of determining whether the acquired number of operation signals exceeds the predetermined value N1 or not (step S13), and the processing of transmitting the alarm information (second alarm information) A1 to the second terminal 50 when it is determined that the acquired number of operation signals exceeds the predetermined value N1 (step S14). Therefore, the manager M having the second terminal 50 receiving the alarm information A1 can be informed that there is an emergency call from the worker U. When the acquired number of operation signals does not exceed the predetermined value N1, for example, it is highly probable that the operation signals are generated as the clothes of the worker U and the operation unit 16 rub against each other when the worker U goes up and down stairs. Thus, when the acquired number of operation signals does not exceed the predetermined value N1, the server 40 does not perform the processing of transmitting the alarm information A1 to the second terminal 50.

In the industrial plant monitoring system 100, the server performs the processing of determining whether there is inclination information exceeding the predetermined inclination angle θ, in the inclination information generated during the first predetermined period T1, or not (step S52), the processing of determining whether a predetermined time is elapsed after the generation of the most recent inclination information or not, when it is determined that there is inclination information exceeding the predetermined inclination angle θ (step S53), and the processing of transmitting the alarm information (third alarm information) A5 to the second terminal 50 when it is determined that the predetermined time is elapsed after the generation of the most recent inclination information (step S55). Therefore, the manager M having the second terminal 50 receiving the alarm information A5 can be informed, for example, that there is no response from the worker U because the worker U has fallen over and fainted.

For example, there are cases where the worker U lies down on the floor of the industrial plant so as to carry out work such as maintenance of a device. Therefore, in the industrial plant monitoring system 100, when there is inclination information exceeding the predetermined inclination angle θ, the processing of transmitting the alarm information A5 is not immediately performed. Instead, the processing of transmitting the alarm information A5 is performed when a predetermined time is elapsed after the generation of the most recent inclination information.

In the industrial plant monitoring system 100, the second terminal 50 has the display unit 56 displaying the alarm information A2. Therefore, the manager M having the second terminal 50 can learn the state of the worker U, based on the display on the display unit 56.

The industrial plant monitoring system 100 includes the first base station 20 receiving the inclination information from the first terminal 10 and transmitting the inclination information to the server 40. When transmitting the inclination information, the first base station 20 transmits the position information of the first base station 20 to the server 40. The alarm information A2 includes the position information of the first base station 20. Therefore, the manager M having the second terminal 50 can be informed of the position of the first base station 20 receiving the inclination information.

In the industrial plant monitoring system 100, the alarm information A2 includes the identification information of the first terminal 10. Therefore, the manager M having the second terminal can identify the worker U wearing the first terminal 10 transmitting the inclination information.

The present disclosure includes a configuration that is substantially the same as a configuration described in the embodiment, for example, a configuration having the same function, method, and result, or a configuration having the same objective and effect. The present disclosure also includes a configuration formed by replacing a non-essential part of a configuration described in the embodiment. The present disclosure also includes a configuration achieving the same advantageous effect as a configuration described in the embodiment, or a configuration achieving the same objective. The present disclosure also includes a configuration formed by adding a known technique to a configuration described in the embodiment.

The following contents are derived from the foregoing embodiment and modification examples.

According to an aspect, an industrial plant monitoring system includes: a first terminal attached to a worker and having a gyro sensor generating inclination information based on a movement of the worker; a server receiving the inclination information; and a second terminal configured to communicate with the server. The server performs processing of acquiring a number of pieces of the inclination information generated during a predetermined period and exceeding a predetermined inclination angle, processing of determining whether the acquired number of pieces of the inclination information exceeds a predetermined value or not, and processing of transmitting first alarm information to the second terminal when it is determined that the number of pieces of the inclination information exceeds the predetermined value.

This industrial plant monitoring system can inform a manager having the second terminal receiving the first alarm information, for example, that the worker has become unable to stand normally and has continuously fallen over. Thus, the industrial plant monitoring system can prevent the worker from being left fallen for a long period.

According to another aspect, in the industrial plant monitoring system, the first terminal may have an operation unit operated by the worker. The first terminal may generate an operation signal when the operation unit is operated. The server may perform processing of acquiring a number of the operation signals generated during the predetermined period, processing of determining whether the acquired number of the operation signals exceeds a predetermined value or not, and processing of transmitting second alarm information to the second terminal when it is determined that the acquired number of the operation signals exceeds the predetermined value.

This industrial plant monitoring system can inform the manager having the second terminal receiving the second alarm information that there is an emergency call from the worker.

According to still another aspect, in the industrial plant monitoring system, the gyro sensor may generate the inclination information only when there is a movement of the worker. The server may perform processing of determining whether or not there is the inclination information exceeding the predetermined inclination angle, in the inclination information generated during the predetermined period, processing of determining whether or not a predetermined time is elapsed after the generation of the inclination information that is most recent, when it is determined that there is the inclination information exceeding the predetermined inclination angle, and processing of transmitting third alarm information to the second terminal when it is determined that the predetermined time is elapsed after the generation of the inclination information that is most recent.

This industrial plant monitoring system can inform the manager having the second terminal receiving the third alarm information, for example, that there is no response from the worker because the worker has fallen over and fainted.

According to still another aspect, in the industrial plant monitoring system, the second terminal may have a display unit displaying the firsts alarm information.

This industrial plant monitoring system enables the manager having the second terminal to learn the state of the worker, based on the display on the display unit.

According to still another aspect, the industrial plant monitoring system may include a base station receiving the inclination information from the first terminal and transmitting the inclination information to the server. The base station may transmit position information of the base station to the server, when transmitting the inclination information. The first alarm information may include the position information.

This industrial plant monitoring system can inform the manager having the second terminal of the position of the base station receiving the inclination information.

According to still another aspect, in the industrial plant monitoring system, the first alarm information may include identification information of the first terminal.

This industrial plant monitoring system enables the manager having the second terminal to identify the worker wearing the first terminal transmitting the inclination information.

What is claimed is:

1. An industrial plant monitoring system comprising:

a first terminal attached to a worker and having a gyro sensor configured to generate inclination information based on a movement of the worker;

a server;

a base station configured to receive the inclination information from the first terminal and transmit the inclination information to the server, wherein the base station transmits position information of the base station to the server, when transmitting the inclination information; and a second terminal configured to communicate with the server, wherein the server is configured to:

acquire a number of pieces of the inclination information generated during a predetermined period and exceeding a predetermined inclination angle, determine whether the acquired number of pieces of the inclination information exceeding the predetermined inclination angle exceeds a first predetermined value or not, and transmit first alarm information to the second terminal when it is determined that the number of pieces of the inclination information exceeds the first predetermined value, wherein the first alarm information includes the position information.

2. The industrial plant monitoring system according to claim 1, wherein the first terminal has an operation unit operated by the worker, the first terminal is configured to generate an operation signal when the operation unit is operated, and the server is further configured to:

acquire a number of operation signals generated during the predetermined period, determine whether the acquired number of the operation signals exceeds a second predetermined value or not, and transmit second alarm information to the second terminal when it is determined that the acquired number of the operation signals exceeds the second predetermined value.

3. The industrial plant monitoring system according to claim 1, wherein the gyro sensor is further configured to generate the inclination information only when there is the movement of the worker, and the server is further configured to:

determine whether or not there is the inclination information exceeding the predetermined inclination angle, in the inclination information generated during the predetermined period, determine whether or not a predetermined time is elapsed after generation of the inclination information that is most recent, when it is determined that there is the inclination information exceeding the predetermined inclination angle, and transmit third alarm information to the second terminal when it is determined that the predetermined time is elapsed after the generation of the inclination information that is most recent.

4. The industrial plant monitoring system according to claim 1, wherein the second terminal has a display unit configured to display the first alarm information.

5. The industrial plant monitoring system according to claim 1, wherein the first alarm information includes identification information of the first terminal.

* * * * *